US006606934B1

(12) United States Patent
Rock et al.

(10) Patent No.: US 6,606,934 B1
(45) Date of Patent: Aug. 19, 2003

(54) ERGONOMIC GAS OPERATED GUN BARREL AND METHOD OF SHORTENING A GAS OPERATED GUN

(75) Inventors: Michael B. Rock, Argyle, WI (US); James E. Ribordy, South Beloit, IL (US)

(73) Assignee: Rinky Dink Systems, Inc., South Beloit, IL (US)

( * ) Notice: Subject to any disclaimer, the term of this patent is extended or adjusted under 35 U.S.C. 154(b) by 0 days.

(21) Appl. No.: 10/233,154

(22) Filed: Aug. 30, 2002

(51) Int. Cl.[7] ..... F41A 5/00
(52) U.S. Cl. ..... 89/192
(58) Field of Search ..... 89/192, 191.01, 89/191, 193

(56) References Cited

U.S. PATENT DOCUMENTS 4,102,242 A * 7/1978 Liedke ..... 89/191.01
4,207,798 A * 6/1980 Hayashi ..... 89/191.01
4,220,071 A * 9/1980 Seiderman ..... 89/128
5,959,234 A * 9/1999 Scaramucci et al. ..... 89/193

OTHER PUBLICATIONS

Kuhnhausen, Jerry, *The U.S. .30 Caliber Gas Operated Service Rifles, A Shop Manual, vol. I & II*, United States of America.

* cited by examiner

*Primary Examiner*—Charles T. Jordan
*Assistant Examiner*—Jordan Lofdahl
(74) *Attorney, Agent, or Firm*—Leydig, Voit & Mayer, Ltd.

(57) ABSTRACT

Presented is a gas operated, semi-automatic rifle having a shortened barrel. For actuating a receiver to provide the semi-automatic feature, the rifle has a gas system including a gas cylinder assembly attached to the barrel at a second angular position relative to the barrel. For linking the gas cylinder assembly with the receiver, an operating rod is provided having a charging arm engaging the receiver and a distal end located at a first angular position relative to the barrel. The gas cylinder assembly and the distal end are hence coextensive to each other, eliminating the length of the barrel otherwise necessary to position the gas cylinder assembly and the distal end in a linear relationship. To provide for interaction between the gas cylinder assembly and the operating rod, an abutment block is attached to the operating rod and positioned at the second angular location.

17 Claims, 5 Drawing Sheets

ERGONOMIC GAS OPERATED GUN BARREL AND METHOD OF SHORTENING A GAS OPERATED GUN

STATEMENT REGARDING FEDERALLY SPONSORED RESEARCH

This invention was made in part with government support under Contract No. N0016402HOKX9 awarded by the U.S. Crane Naval Surface Warfare Division, located in Crane, Ind. The government may have certain rights in this invention.

FIELD OF THE INVENTION

The present invention relates generally to gas operated guns, and more particularly to gas powered semi-automatic rifles.

BACKGROUND OF THE INVENTION

Since production began in the late 1950's, over a million 0.30 caliber M-14 service rifles have been manufactured for the United States Armed Forces. Additionally, an uncounted number of M-14's and variations thereof have been produced for commercial use and for use in foreign countries. Furthermore, numerous spare components have been produced and stockpiled for the M-14 and its variants such as the M1-A (hereinafter rifles of this design family are referred to as "M-14"). Though it is no longer used as a standard issue combat weapon in the U.S. military, police forces and foreign armed forces sometimes will still use the M-14. There are currently a large number of M-14 rifles that are stockpiled and sparsely used.

The M-14 is a semi-automatic and/or fully automatic weapon meaning that the rifle automatically reloads itself each time a round is fired. The M-14 includes a bolt that slides within a receiver to eject the spent cartridge and chamber a new round for firing. The receiver and bolt are located toward the butt end of the rifle where the trigger is located. The rifle also includes an operating rod that slides relative to the housing and is manually operable against the action of a return spring to facilitate manual sliding of the bolt and therefore loading of bullets into the receiver.

To provide the force and motion for mechanically driving the bolt within the receiver and carrying out the rifle's cycle of operation, a gas operated rifle includes a gas cylinder assembly. The gas cylinder assembly temporarily stores and then utilizes a propellant gas charge which is generated in the barrel each time a round is fired. For the M-14 rifle, the gas cylinder assembly comprises a housing and a piston that in combination define a chamber that receives a working gas charge that is used to propel the piston and thereby power the bolt rearwardly through engagement with the operating rod. The gas cylinder assembly is located away from the receiver near the discharge end of the barrel where it is mounted directly under and parallel to the barrel. The piston of the gas cylinder assembly acts upon and is acted upon by the distal end of the operating rod. The operating rod includes an actuating face at its foremost distal end that is urged forwardly against the piston under the action of the return spring. To ensure proper engagement, the distal end of the operating rod is offset from the barrel at the same angular position in axial alignment with the gas cylinder assembly. For purposes of reference, a prior art M-14 rifle according to the above description is shown in FIGS. 1 and 2. Further details of a prior art M-14 rifle may also be had to *The U.S.* 0.30 *Caliber Gas Operated Service Rifles; A Shop Manual*

*Volumes I & II*, Copyright 1995 by Jerry Kuhnhausen, or other similar gun operation manuals.

The time frame in which the rifle's cycle of operation is completed appears to the rifle user to be almost instantaneous. Accordingly, the M-14 can be repeatedly fired as fast as the user can pull the trigger. To provide for mechanical repetition and to contend with the speeds and forces generated by the cycle of operation, the rifle components must be precisely located and accurately aligned with one another. Changing the pre-set locations and dimensions of these components poses the potential risk of adversely affecting the rifle's operation.

Typically, the standard M-14 rifle has a barrel that is typically 23 inches in length measured by dropping a rod into the barrel butting up against the front face of the bolt in the foremost position, and measuring rod length at the front most end of the barrel without a flash suppressor or components mounted to the barrel end (e.g. stripped down). Unfortunately the length of the M-14 is a significant problem in applications where is desirable to have a short rifle. For instance, paratroopers often exit airplanes through narrow hatchways when making their jumps. Also, soldiers and/or police forces operating in urban settings often must travel down tight corridors, pass through narrow doorways, or swing around hallway corners. Likewise, soldiers must operate within the tight confines of a ship and pass through narrow hatchways such as those on a submarine. In these and other similar applications, the standard length of the M-14 is typically considered to be too much of a drawback to warrant consideration for use. In particular, because of the long length of the M-14 barrel, the end of the barrel or muzzle is prone to strike walls, hatchways, and other obstructions, thereby severely limiting the maneuverability of the soldier or officer. Due to this significant drawback, the M-14 is not a weapon of choice and is not frequently used, despite the fact that it is a readily available weapon that often exhibits superior reliability compared with other existing shorter rifles.

Merely cutting off the end of the barrel does not provide a sufficient solution, because the barrel may only be cut a small fraction to only about 16½ inches before interfering with the position of the gas cylinder assembly and its engagement with the actuating face or distal end of the operating rod. Cutting off the gas cylinder assembly is not a realistic possibility either as that would remove the semi-automatic capabilities of the weapon and thereby create other more serious drawbacks. Hence, the M-14 rifle remains too long for use in many potential applications.

BRIEF SUMMARY OF THE PRESENT INVENTION

The present invention provides a gas operated, semi-automatic rifle, such as the M-14, with a shortened barrel functioning in conjunction with the existing design of most rifle components, with few design modifications and/or substitute parts. The shortened barrel supports the gas cylinder assembly at a different angular position with respect to the barrel axis than the directly underneath position where the gas cylinder assembly is currently located according to current design. Instead of engaging the actuating face at the distal end of the operating rod, the operating rod abuts against the gas cylinder assembly at a new position closer to the receiver end of the rifle, thereby eliminating the need of contact with the distal end of the operating rod. Accordingly, the length of the barrel previously needed to support the gas cylinder assembly in an end-to-end relationship with the operating rod can be greatly reduced, and thereby make the rifle more ergonomic and suitable for applications where a shorter rifle is desired or required.

The present invention also provides a method of retrofitting existing rifles with a kit comprising shortened barrels with a rearranged gas cylinder assembly. This makes the invention applicable to the large stockpiles of M-14 weapons currently in existence.

An advantage of the present invention is that it provides a shortened gas operated, semi-automatic rifle that can be built primarily from existing stockpiled rifles and rifle components. Another advantage of the present invention is that it provides an inexpensive method of retrofitting existing rifles by reusing many of the costlier components. The invention also contemplates the manufacture of entirely new shorter M-14 rifles in which the design of the vast majority of rifle components are unchanged, and therefore the well known reliability characteristics that have been long established for the M-14 rifle continue with immediate market recognition.

These and other advantages and features of the present invention will be apparent from the detailed description and accompanying drawings.

DETAILED DESCRIPTION OF THE DRAWINGS

Figure 1:
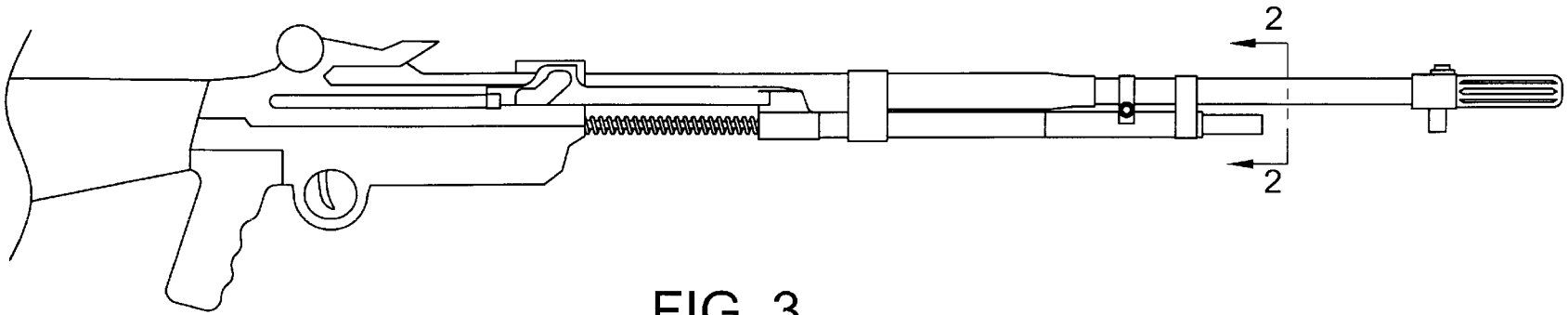
FIG. 1 (PRIOR ART)
FIG. 1 is a side view of a prior art rifle.

Referring to the drawings, a modified and shortened M-14 rifle 100 according to a preferred embodiment of the present invention is illustrated in FIGS. 3–6. FIG. 7 illustrates a retrofit kit 125 that may be used to modify the prior art rifle shown in FIGS. 1–2 to convert it into the shortened rifle 100 shown in FIGS. 3–6. Although a retrofit kit 125 is illustrated, it will be appreciated that the invention is also applicable to newly manufactured rifles in which the design for the most of the old rifle components remain the same except for the design modifications shown in the kit 125 of FIG. 7.

Figure 5:
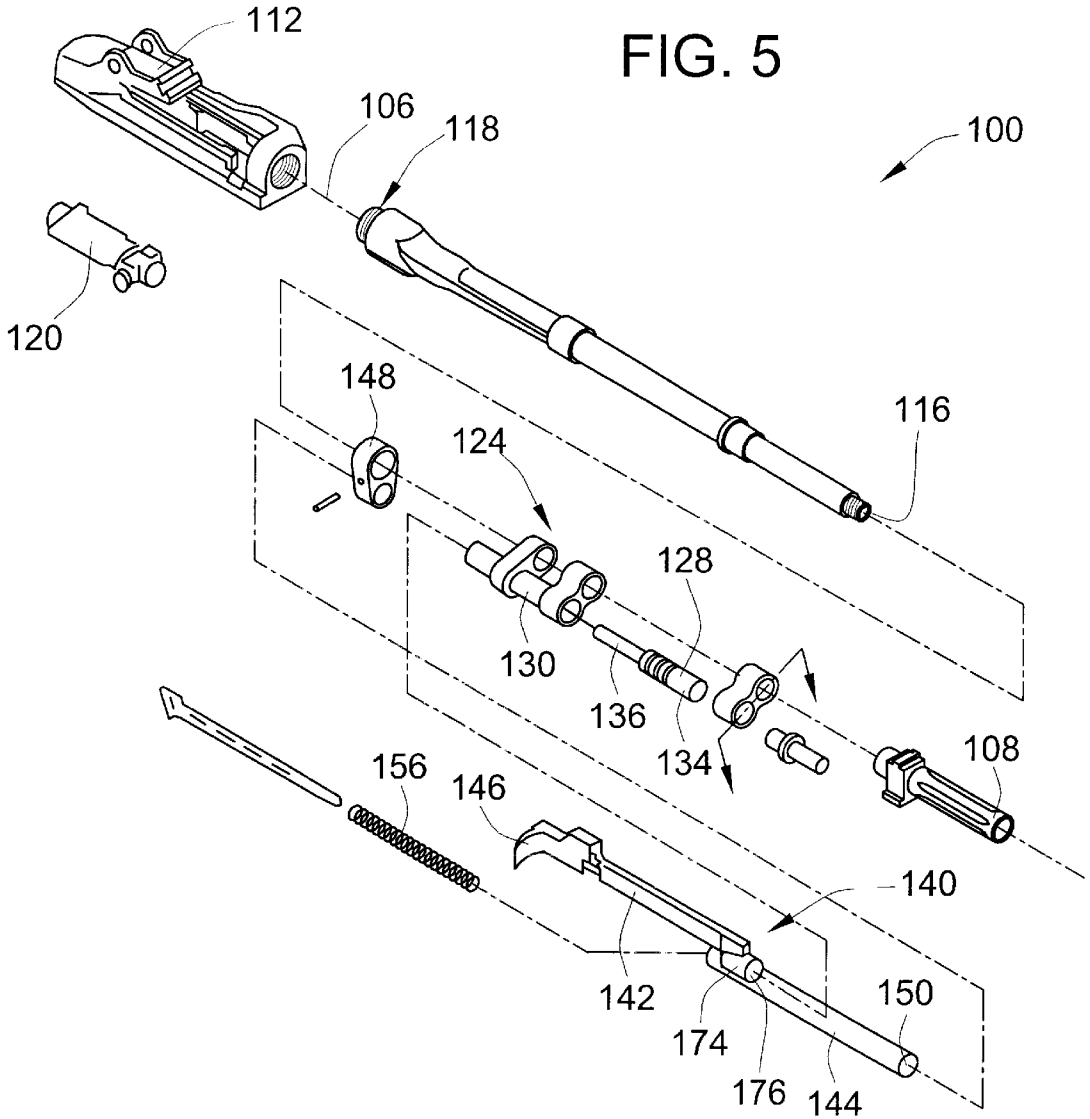
FIG. 5 is an exploded assembly view of the rifle shown in FIG. 3.

The rifle 100 generally includes an elongated but shortened machined barrel 102 that extends forward along a longitudinal axis 106 from a receiver 112 until it terminates at a discharge end 108. Located on the underside of the rifle is a trigger 110 and a removable magazine 114 which contains bullet rounds. Referring to FIG. 5, the barrel threadably mounts into the front of the receiver 112 and extends forwardly therefrom towards its discharge end 108. The barrel 102 defines a bore 116 that also extends along axis 106. Formed into the barrel 102 at the location where it connects with the receiver 112 is chamber 118 in which a bullet or round can be chambered and fired. A bolt 120 slides and reciprocates within the receiver 112 to effect loading, chambering and firing of bullet cartridges, and also discharge of spent bullet cartridges.

The rifle 100 also includes an operating rod 144 that slides relative to the barrel and receiver, and that acts upon the bolt 120. The operating rod 144 includes a rearwardly disposed charging handle portion 142 and a forwardly disposed guide rod portion 144. The charging handle portion 142 slides on the receiver 112 and includes an operator lever 146 that can be manually actuated to draw the bolt 120 to the rear to facilitate manual loading of a bullet cartridge. The guide rod portion 144 slides within a guide bracket 148 that is mounted to the vertical underside of the barrel 102. A return spring 156 supported by the receiver 112 and axially aligned with the guide rod portion 144 biases the operating rod 144 forwardly toward the discharge end 108 of the barrel. The guide bracket 148 guides the movement of the operating rod 144 over the entire reciprocating travel of the operating rod 144.

To provide for semi-automatic operation of the rifle, the rifle 100 includes a gas cylinder assembly 124 that assists in driving the bolt rearwardly each time the rifle is fired. The gas cylinder assembly 124 includes a piston 128 and a cylindrical housing 130 that encloses and defines an internal piston chamber 132. The piston 128 slides and linearly reciprocates within the piston chamber 132. The piston includes a larger diameter portion 134 that engages the cylindrical inner periphery of the housing 130 and a smaller diameter shank portion 136 that extends through the rear of the housing 130 for engaging the operating rod 144. The piston chamber 132 is in fluid communication with the barrel bore 116 through a cross-passage 138 that extends laterally between the housing 130 and the barrel 102. When a round is fired, propellant gas from the bore 116 enters the internal piston chamber 132 and provides a stored gas energy charge that is almost immediately used to assist in driving the operating rod 144 and the bolt 120 rearward. As the gas energy charge is used, the gas pressure forces the piston 128 rearward which in turn initiates rearward movement of the operating rod 144 to unlock the bolt 116 and drive the bolt 116 rearwardly. Once the bolt 116 completes its rearward stroke and begins to travel forwardly under the action of the return spring 156, the piston 128 is disposed at its rearmost position with the smaller diameter shank portion 136 projecting out the rear end of the housing 130. As the return spring 156 returns the bolt 116 and the operating rod 144 forward to chamber a new round, the operating rod 144 also engages the shank portion 136 of the piston 128 resetting the piston 128 to its foremost position to prepare it for receiving the next gas charge.

The operation of the bolt, the receiver, the operating rod and the gas cylinder assembly is well known by those skilled in the art. Although general details of the rifle components and their operation are described above to facilitate a greater understanding of the disclosed embodiment and rifle design modifications set forth herein, reference can be had to *The U.S.* 0.30 *Caliber Gas Operated Service Rifles; A Shop Manual Volumes I & II*, Copyright 1995 by Jerry Kuhnhausen, the entire disclosure of which is hereby incorporated by reference, or other gun manuals for the M-14 rifle for further information about the operation of the M-14 rifle.

Figure 3:
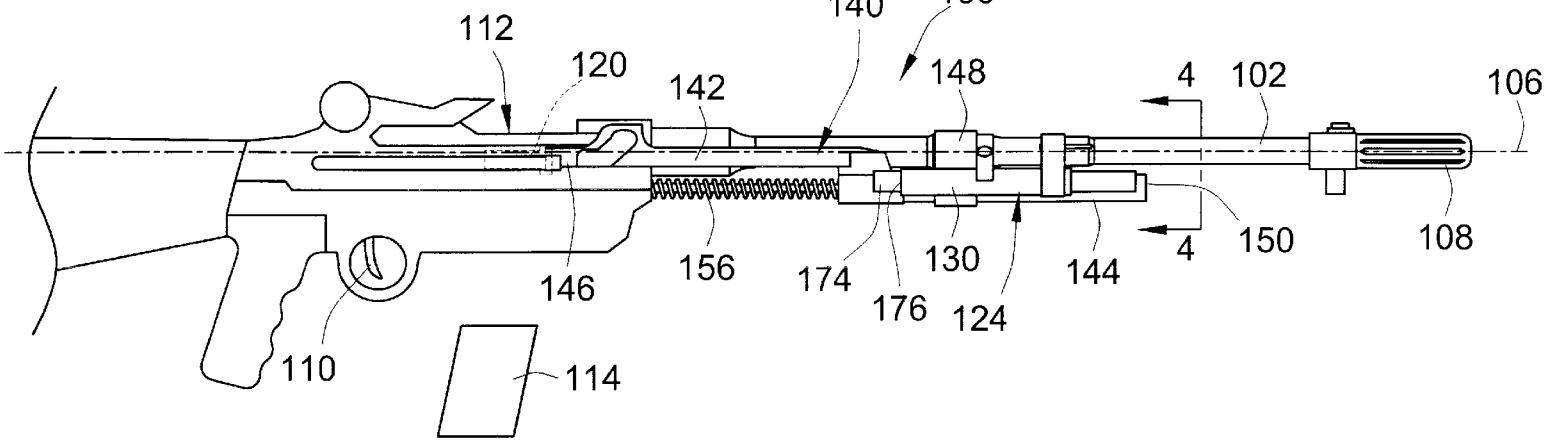
FIG. 3 is a side view of a rifle according to an embodiment of the present invention.
Figure 2:
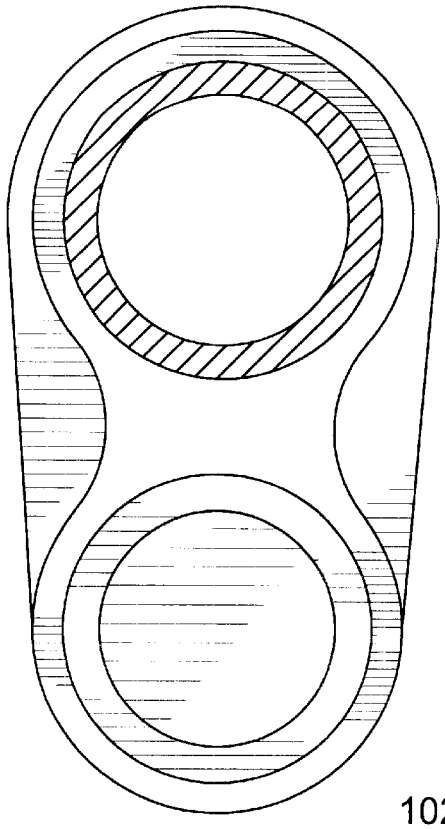
FIG. 2 (PRIOR ART)
FIG. 2 is a cross section of the prior art rifle shown in FIG. 1 taken about line 2—2.

In accordance with an aspect of the present invention, the barrel 102 of the disclosed embodiment of FIG. 3 is substantially shorter as compared with the prior art rifle shown in FIG. 1. In the disclosed embodiment, the shortened barrel 102 is enabled by moving the location of the gas cylinder assembly 124 substantially rearward and to a different angular position out of the way of the guide rod portion 144 of the operating rod 140. Thus, the gas cylinder assembly 124 is no longer directly under the barrel at the 6 o'clock position as per the prior art in FIG. 1. Instead a different portion of the operating rod 140 is used to engage the piston 128. This renders the actuating face 150 at the distal end of operating rod 144 (which once was operable to engage the piston of gas cylinder assembly) inoperable and free of contact of any of the rifle components. A quick comparison of FIGS. 1,2 of the prior art on the one hand and FIGS. 3,4 on the other hand of the disclosed embodiment demonstrate these differences.

Figure 4:
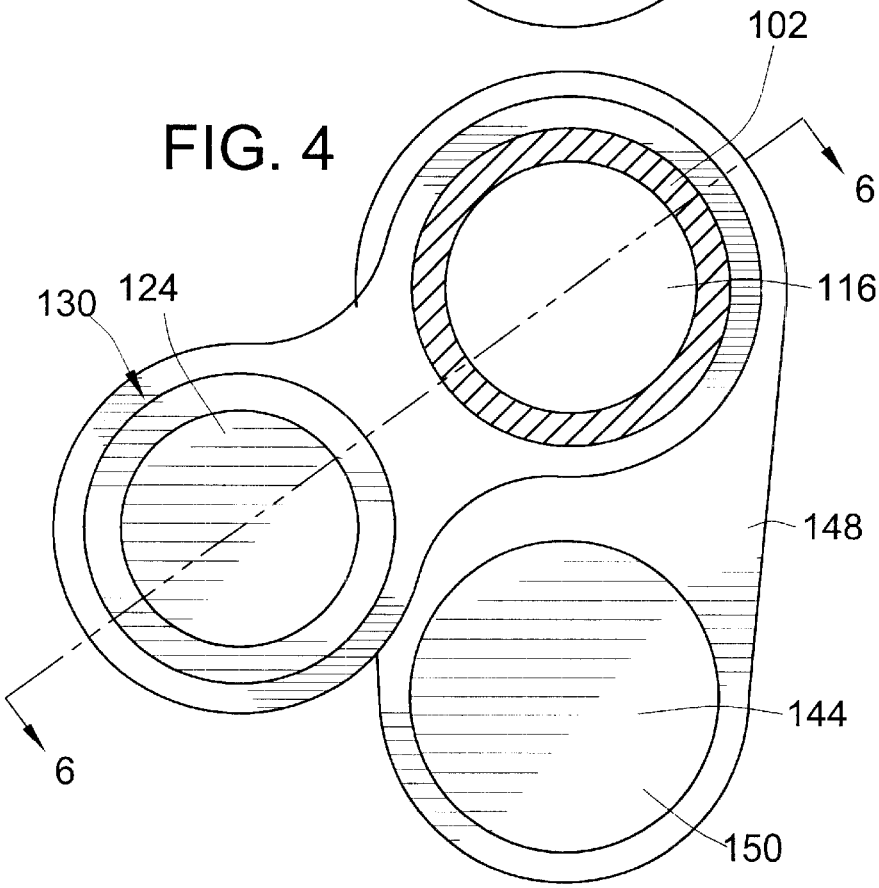
FIG. 4 is a cross section of the disclosed rifle embodiment of FIG. 3 taken about line 4—4.

As illustrated in FIGS. 3–4, modifying the longitudinal position and angular position of the gas assembly 124 positions the gas cylinder assembly 124 at an adjacent angular location along side of the guide rod portion 144 (rather than in axial alignment with the distal end 150 of the guide rod portion 144) and much closer towards the receiver 112. By positioning the gas cylinder assembly along side of and coextensive with guide rod portion 144 the rifle barrel 102 can be shortened substantially and can even be shorter than the prior location of the old gas system.

To provide a reliable surface on the operating rod 144 for engaging the piston 128 of the gas cylinder assembly 124, an abutment block 174 is welded or secured to a transition portion 148 between the charging handle portion 142 and the guide rod portion 144. If desired, a new operating rod having the abutment block 174 may also be provided in the kit 125 if one does not want the existing operating rod 144 to be modified. The abutment block 174 is axially aligned at the same angular position as the piston shank portion 136 of the gas cylinder assembly 124. The abutment block 174 has a flat abutment surface 176 perpendicular to the axis 106 that squarely engages the front end of the piston shank 136. The square planar contact between the abutment block 174 and the piston 128 substantially prevent side loads from being imposed on the operating rod 144 during operation. Abutment surface 176 therefore functions similarly to the old function of the now inoperable actuating face 154.

As shown in FIG. 3, the return spring 156 continues to be in axial alignment and engagement with the guide rod portion 144 of the operating rod 140 even after modification. No modifications to its position, length, force or spring coefficients are necessary. The return spring 156 continues to bias the operating rod 144 towards the discharge end 108. Since the length of the guide rod portion 144 also has not changed, the guide rod portion 144 and the guide bracket 148 continue to function together to support and guide the operating rod throughout its entire range of travel. No modifications to the position of the guide bracket 148 are necessary either.

As shown in the illustration in FIG. 3, moving the gas cylinder assembly 168 rearward to be axially adjacent to the intermediate transition portion 148 of the operating rod can reduce several inches from the standard barrel length. Shorter barrel lengths less than the standard barrel length of 23 inches and in fact shorter than a cut off barrel of 16½ inches can be achieved. Barrel lengths of between about 9 inches and about 16 inches can be achieved with the present invention (measured by dropping a rod into the barrel butting up against the front face of the bolt in the foremost position, and measuring rod length at the front most end of the barrel without a flash suppressor or components mounted to the barrel end (e.g. stripped down)). It is an advantage that this provides the modified M-14 rifle with a length that is short enough to be used in modern combat situations where military commands demand a shorter rifle. However, it will be appreciated that the invention may also be applicable to longer barrels up to 30 inches as the new configuration and position of the gas cylinder assembly can provide benefits for longer rifles as well.

Figure 6:
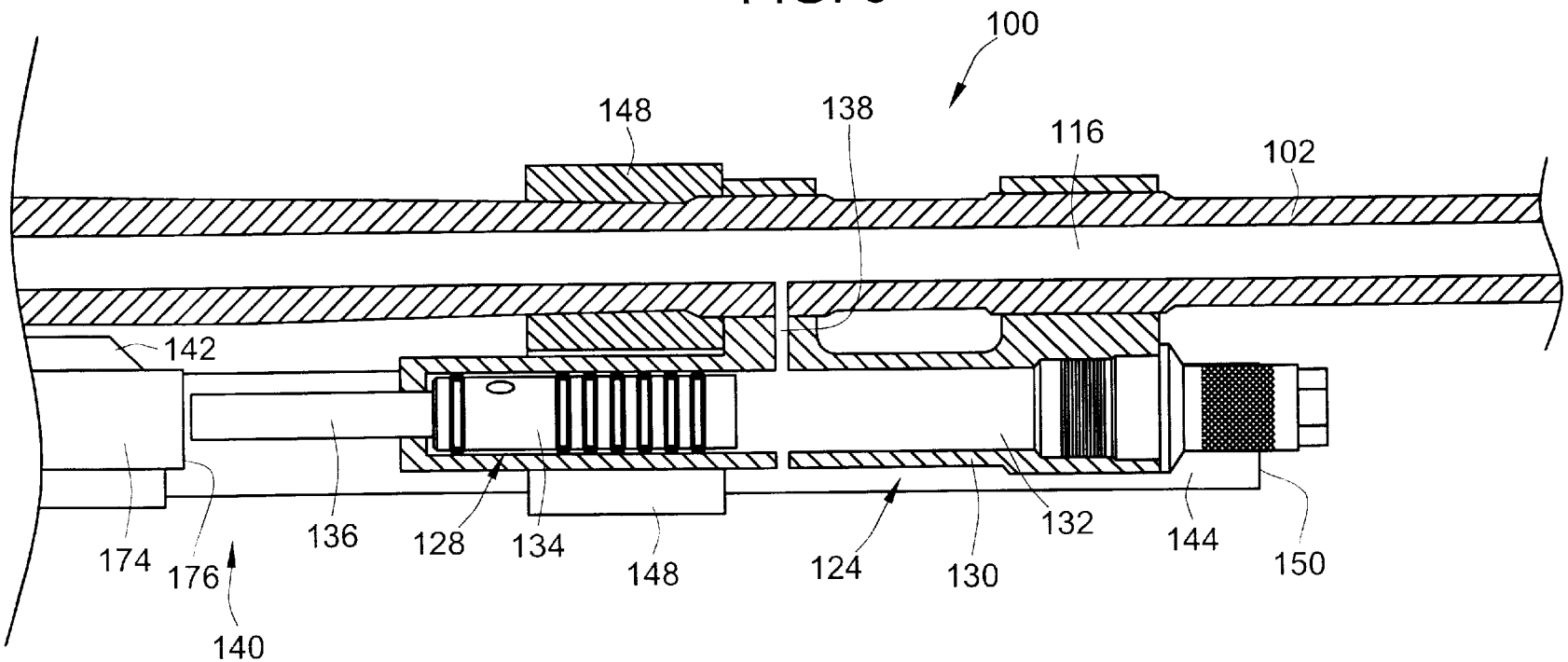
FIG. 6 is a cross section taken at a skewed angle relative to horizontal about line 6—6 as shown in FIG. 4.
Figure 7:
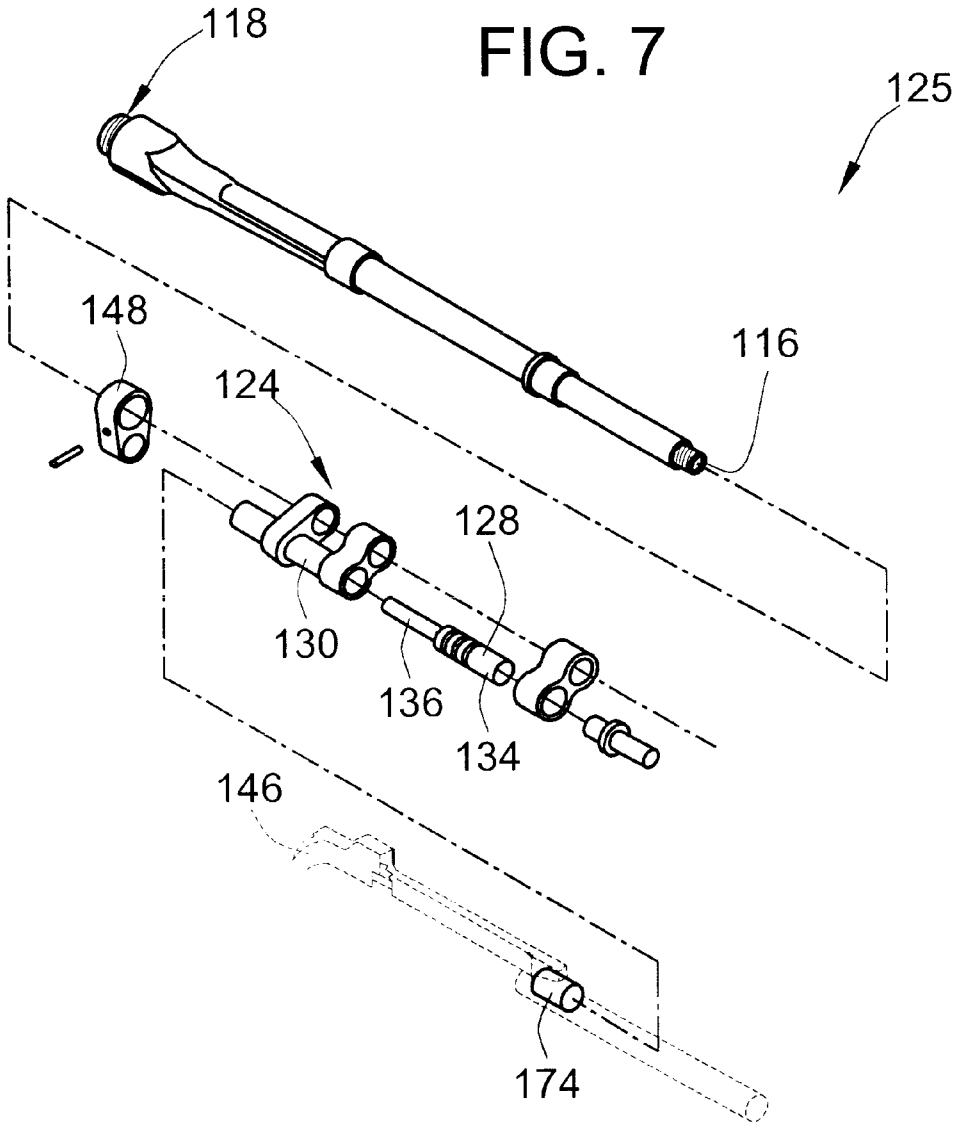
FIG. 7 is a perspective view of a kit modifying the longer prior art rifle of FIG. 1 into the shorter rifle of the disclosed embodiment as shown in FIG. 3.

While the abutment block 174 is illustrated as secured to transition portion 148 in FIG. 6, the abutment block could be located at other locations on the operating rod 144. The longitudinal position of the abutment surface 176 can affect the distance between the gas cylinder assembly 168 and the receiver 112, and thereby the barrel length. Furthermore, the gas cylinder assembly may be positioned at other angular positions than those illustrated in FIGS. 5 and 6 so long as the abutment block or portion of the operating rod is in a corresponding angular position.

Thus, the present invention provides an economical way of shortening the barrel length of a gas operated, semi-automatic rifle. The shortened rifle reuses many of the existing expensive rifle components but rearranges the gas system so that the location of the gas cylinder assembly is no longer required to be directly underneath the rifle nor is the location required to be linearly aligned with the distal end. The length of the barrel can therefore be shortened greatly.

The use of the terms "a" and "an" and "the" and similar referents in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A gas operated gun, comprising:

a receiver;

a bolt slidable within the receiver;

an elongated barrel mounted to the receiver, the barrel defining a bore extending forwardly from the receiver along a longitudinal axis toward a discharge end;

an operating rod including a charging handle portion and a guide rod portion, the operating rod movable relative to the bolt and the barrel to actuate the bolt, the charging handle portion including a manual operator lever, the guide rod portion disposed at a first angular position relative to the longitudinal axis and extending forwardly toward a distal end;

a spring supported by the receiver urging the operating rod toward the discharge end of the barrel;

a gas cylinder assembly including a housing and a piston, the housing including an internal piston chamber and a fluid passageway in fluid communication with the bore, the piston being reciprocally movable within the internal piston chamber;

a contact interface between the operating rod and the piston at an intermediate position between the operator lever and the distal end, the contact interface being disposed at a second angular position angularly offset from said first angular position of the guide rod portion.

2. The gas operated gun of claim 1, wherein the guide rod portion and the gas cylinder assembly extend coextensively with each other at angularly adjacent locations.

3. The gas operated gun of claim 1, wherein the operating rod includes an abutment offset rearwardly relative to the distal end contacting the piston of the gas cylinder assembly.

4. The gas operated gun of claim 3 wherein the abutment is provided proximate a transition between the charging handle portion and the guide rod portion.

5. The gas operated gun of claim 3, wherein the abutment is provided by an abutment block welded to the operating rod.

6. The gas operated gun of claim 1, wherein the distal end defines an inoperable actuating face proximate the discharge end, whereby the gun has been modified and comprises new rifle components in combination with used rifle components.

7. The gas operated gun of claim 1 wherein the barrel has a longitudinal length that is shorter than about 16 inches.

8. The gas operated gun of claim 1 wherein the barrel has a longitudinal length of between about 9 inches and about 30 inches.

9. A method of retrofitting and shortening a gas operated gun, the gun including a first barrel mounted to a receiver and extending forwardly therefrom along a longitudinal axis, a bolt slidable in the receiver, and an operating rod acting upon the bolt to facilitate sliding movement of the bolt in the receiver, the first barrel having a first gas cylinder assembly at a first angular position relative to the longitudinal axis, the first gas cylinder assembly contacting an actuating face of the operating rod; the method comprising:

machining a second barrel to a shorter length than the first barrel;

mounting a second gas cylinder assembly on the second barrel, the second gas cylinder having a second angular position relative to the longitudinal axis that is different than the first angular location when the second barrel mounted to the receiver;

removing the first barrel from the receiver;

mounting the second barrel to the receiver; and engaging the second gas cylinder assembly with an abutment located rearwardly of the position of the actuating face.

10. The method of claim 9 utilizing a different portion of the operating rod to engage the gas cylinder assembly and rendering the operating face inoperable.

11. The method of claim 10, further comprising providing an abutment surface at the different portion of the operating rod, the abutment surface in an axially spaced relation relative to the inoperable operating face and located at the same angular position relative to the longitudinal axis as the gas cylinder assembly.

12. The method of claim 11, wherein the abutment surface is closer to the receiver than the inoperable operating face.

13. The method of claim 12, further comprising urging the abutment surface against the gas cylinder assembly with a spring supported by the receiver.

14. The method of claim 9, further comprising removing a first gas cylinder assembly and replacing with a second gas cylinder assembly.

15. A kit for retrofitting and shortening the length of a gas operated gun, the gun including a receiver having a bolt slidable within the receiver, a first barrel of a predetermined length defining a bore and extending along a longitudinal axis, a operating rod having a charging arm engaging the bolt and a distal end offset from the longitudinal axis at a first angular position, a first gas cylinder assembly including a internal piston chamber in fluid communication with the bore, the first gas cylinder assembly linearly aligned with the distal end; the kit comprising:

a second barrel shorter than the first barrel;

a striking abutment for attachment to the operating rod at a second angular position different from the first angular position.

16. The kit of claim 15, further comprising a guide bracket for attachment to the second barrel and to maintain alignment of the operating rod.

17. The kit of claim 15, further comprising a second gas cylinder assembly configured to be located at the second angular position linearly aligned with the striking abutment.

* * * * *